United States Patent [19]

Lin et al.

[11] Patent Number: 4,744,838

[45] Date of Patent: May 17, 1988

[54] METHOD OF CONTINUOUSLY PROCESSING AMORPHOUS METAL PUNCHINGS

[75] Inventors: Kou C. Lin, Mercer County, Pa.; Charles E. Burkhardt, Georgetown County, S.C.; Paul W. Martincic, Mercer County, Pa.

[73] Assignee: Electric Power Research Institute, Inc., Palo Alto, Calif.

[21] Appl. No.: 884,215

[22] Filed: Jul. 10, 1986

[51] Int. Cl.[4] ..... H01F 1/00; C21D 1/26

[52] U.S. Cl. ..... 148/120; 72/38; 72/700; 148/121; 148/403

[58] Field of Search ..... 72/38, 160, 339, 364, 72/700; 148/108, 122, 154, 304, 403, 120, 121

[56] References Cited

U.S. PATENT DOCUMENTS

| | | | |
|---|---|---|---|
| 4,288,492 | 9/1981 | Hiromae et al. | 428/447 X |
| 4,379,004 | 4/1983 | Makino et al. | 148/108 |
| 4,444,602 | 4/1984 | Makino et al. | 148/121 |
| 4,512,824 | 4/1985 | Taub | 148/304 X |
| 4,520,078 | 5/1985 | Rabinowitz et al. | 148/304 X |
| 4,525,222 | 6/1985 | Meguro et al. | 148/304 X |
| 4,596,613 | 6/1986 | Lin et al. | 148/403 X |
| 4,602,969 | 7/1986 | Koshiishi et al. | 148/121 |

FOREIGN PATENT DOCUMENTS

| | | | |
|---|---|---|---|
| 53-133505 | 11/1978 | Japan | 148/403 |
| 60-248817 | 12/1985 | Japan | 148/108 |

*Primary Examiner*—E. Michael Combs

*Attorney, Agent, or Firm*—Flehr, Hohbach, Test, Albritton & Herbert

[57] ABSTRACT

A plurality of separate blanks or punchings can be continually processed by first cutting the strips into the dimensions needed for core punchings prior to thermal and magnetic annealing. Thereafter the cut punchings can be fed into the annealing line a conveyor in the sequence of one after another in series, alternatively side-by-side in parallel. The punchings will be flattened with rollers or a press during the stage of heating from room temperature to approximately 300° C. The molten metals adhering to the laser-cut edges or burrs from the mechanical shear can be mechanically removed at this point by brushing. The strips may then be thermally and magnetically annealed in the soaking area. In one embodiment, the temperature may be 400° C. ±20° C. for 2605-S2 Metglas material and 360° C. ±10° C. for 2605S-C Metglas material with a field of 10 Oe in a non-oxidizing environment. The time required for annealing will depend upon strip gauge and width and also, the need of the end results. In an alternative embodiment, the strips may be annealed at a higher temperature of up to 450° C. for a sequence of one minute periods. In either event, annealing takes place while passing the material through a solenoid in the conveyor furnace to expose the material to magnetic annealing. Thereafter, the annealed strips will be cooled to room temperature as the exist from the furnace. The processed punchings will then be ready for core stacking without further strip winding and unwinding.

8 Claims, 3 Drawing Sheets

Figure 1:
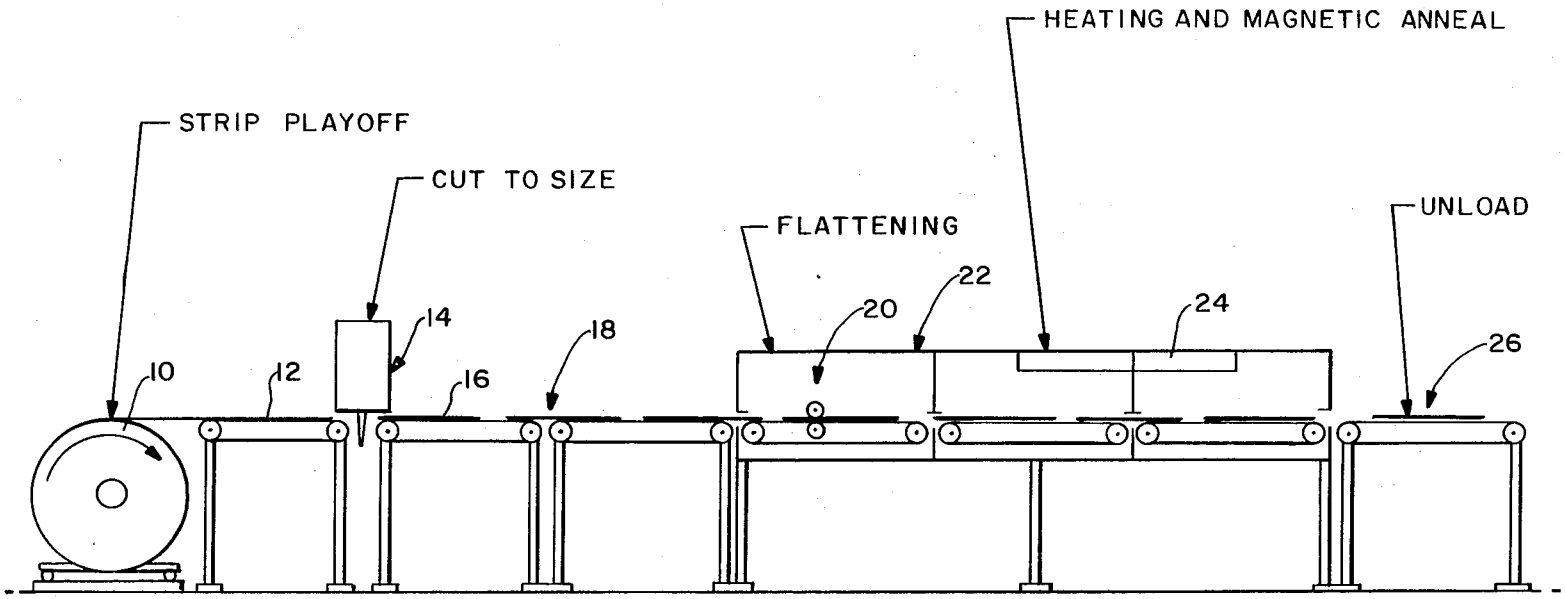

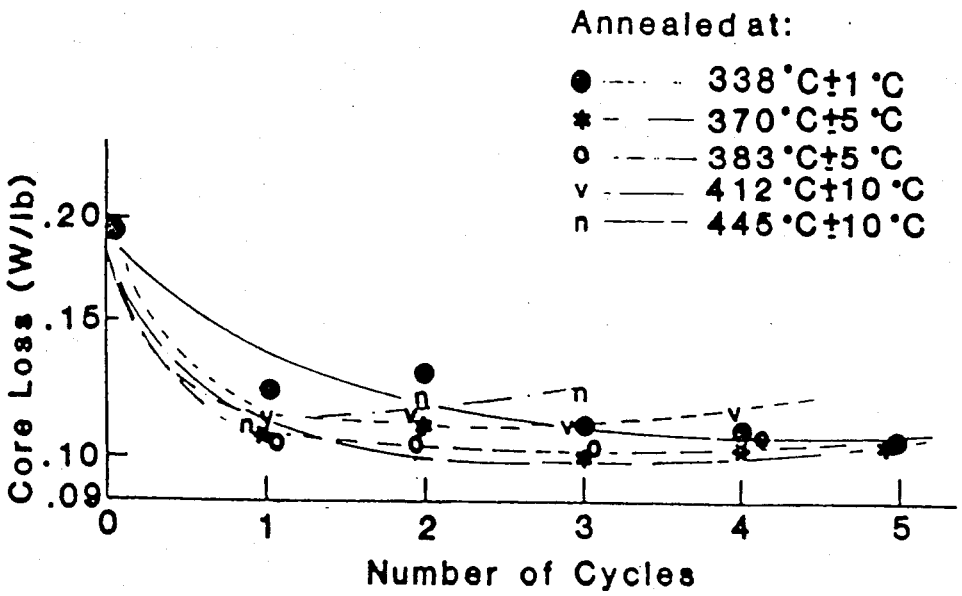
Figure 2. Core Loss at 14 kG Versus Number of Heating Cycles for Amorphous Metal Strips Annealed in a Conveyor Furnace.

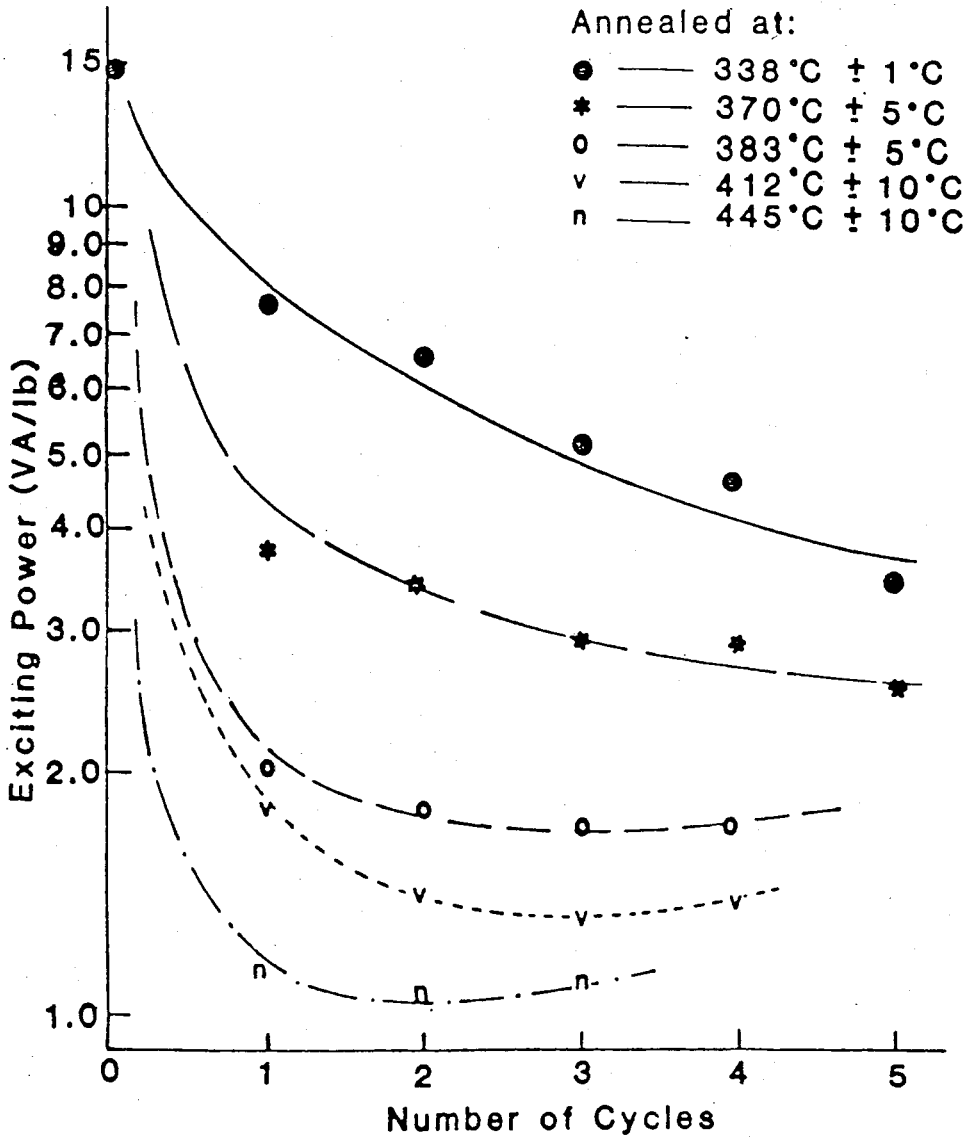
Figure 3. Exciting Power at 14 kG Versus Number of Heating Cycles for Amorphous Metal Strips Annealed in a Conveyor Furnace.

METHOD OF CONTINUOUSLY PROCESSING AMORPHOUS METAL PUNCHINGS

This invention is directed generally to the field of amorphous metal processing, and more particularly to the enhancement of magnetic properties of amorphous metallic alloys.

Amorphous metal alloys result when certain component materials are quenched from the molten state to the solid state at extremely high rates. For example, quenching at a rate of $10^{5°}$ per second or greater results in an alloy which is substantially homogeneous and amorphous in form. That is, the rapid cooling prevents formation of a crystalline structure in the alloy material.

The relevant properties of amorphous metallic alloys are that they possess considerable strength in contrast to conventional high strength alloys which consist of two or more phases. Rather than having a standard stress strain curve having a limited linear elastic range, followed by an elongated plastic strain region terminating at the ultimate strength or breaking point, the amorphous alloys characteristically show a linear elastic region followed by a slightly non-linear region ending at the breaking point. It is this property which makes them adaptive for use in a transformer core.

Amorphous alloys do not show the yield point behavior typical of crystalline alloys; they do show some creep, that is the slow deformation which may occur over long periods of sustained loading.

Magnetically, the alloys are soft materials, in that they possess relatively high permeablility, i.e., the ratio of magnetic flux density produced in the medium to the magnetized force producing it. It is this second quality which also leads to their utilization in transformer cores and the like.

It is an object of the present invention to provide a method for enhancing the fundamental magnetic properties of amorphous metal alloys.

Another objective of the present invention is to enhance the magnetic qualities in a manner which is consistent with their efficient utilization and incorporation into transformer cores or the like.

It has been disclosed in a related application of A. J. Madura entitled "Thermomagnetic Strip Annealing of Amorphous Alloys", assigned to the assignee of the present invention, Ser. No. 895,060 filed Aug. 11, 1986, that amorphous metal strip can be annealed prior to cutting and processing. This approach was taken beacause amorphous alloys are typically synthesized in ribbon shape. In this incorporated application, the reel of amorphous metal strip is unwound and fed through a solenoid in a mesh furnace. The amorphous metal strip is thermally and magnetically annealed a combination of time and temperature in a magnetic field. The material is then recoiled for utilization.

The benefit of this approach is to provide a unique method of annealing amorphous metal strip in a large quantity without any further annealing of each processed strip or processed core.

However, there are certain disadvantages to the approach. For one, it is difficult to run amorphous metal strip continuously in tension through an annealing line without interruption, because of inconsistency in material quality and material cross-section. On occasion, there are many breaks in a reel.

Therefore, it is an objective of the present invention to provide an alternative method for continuous processing of amorphous metal strip material.

Second, amorphous metal is extremely stress sensitive. Rewinding annealed strip into a reel and then unwinding will introduce stress back into the material. It has been found that the smaller the winding reel, the higher the core loss will be. Tightness of winding also affects the loss.

Therefore, it is an objective of the present invention to define an amorphous metal continuous annealing process which does not incorporate rewinding of the material as a step in the process.

It has also been found that annealed strip is much more brittle than cast material. It is likely to be difficult to cut punchings by a mechanical means (either abrasive wheel or conventional shear) without chipping. Therefore, it is an objective of the present invention to provide a process which is consistent with pre-cutting of the amorphous metal strip.

A further disadvantage with known processes is that molten metals adhering to the laser cut edges must be removed prior to core assembling. In such an approach, the laser cutting speed and strip running speed have to be evenly matched, a difficult objective to achieve. Therefore, another objective of the present invention is to provide a method which will eliminate the need for edge cutting of the amorphous metal strip.

According to this invention, in summary, amorphous metal punchings can be continually processed by first cutting the strips into the dimensions needed for core punchings prior to thermal and magnetic annealing. Thereafter the cut punchings can be fed into the annealing line a conveyor in the sequence of one after another in series, alternatively side-by-side in parallel. In a preferred embodiment, the punchings will be flattened with rollers or a press during the stage of heating from room temperature to approximately 300° C.

The molten metals adhering to the laser-cut edges or burrs from the mechanical shear can be mechanically removed at this point at brushing.

The strips may then be thermally and magnetically annealed in the soaking area. In one embodiment, the temperature may be 400° C.±20° C. for 2602-S2 Metglas material and 360° C.±10° C. for 2605S-C Metglas material with a field of 10 Oe in a non-oxidizing environment. The time required for annealing will depend upon strip gauge and width and also, the need of the end results. In an alternative embodiment, the strips may be annealed at a higher temperature of up to 450° C. for a sequence of one minute periods. In either event, annealing takes place while passing the material through a solenoid in the conveyor furnace to expose the material to magnetic annealing. Thereafter, the annealed strips will be cooled to room temperature as the exist from the furnace. The processed punchings will then be ready for core stacking without further strip winding and unwinding.

A detailed description of the present invention from which other objectives and advantages will become apparent will be given with respect to FIG. 1, which shows a view in raised elevation of the essential elements of the sequence of the processing steps for the present invention;

FIG. 2, which shows the relationships of core loss and number of heating cycles carried out in accordance with the present invention; and FIG. 3, which shows the relationship of exciting power and number of heating cycles for amorphous metal.

The present invention is directed to a process for continuously processing amorphous metal cut int the shape of punching. The process as developed is capable of thermally and magnetically annealing amorphous metal strips for less time that the normally required two hours at peak temperture (400° C.±20° C. for 2605-S2 Metaglas and 360° C.±10° C. for 2605S-C Metaglas material with a field of 10 Oe in a non-oxidizing environment).

It is a known that a physically processed amorphous metal core requires stress relief annealing and magnetic directional order annealing to optimize the magnetic properties. Temperature, heating time, field strength and cooling rate are very important. The established annealing conditions for amorphous metal cores according to the incorporated application are two hours with a 10 Oe field at 360°±10° C. for SC alloy and 400°±20° for the S2 alloy.

However, it is time consuming to wind copper wires around a core cross section or around a stack of punchings and then thermally and magnetically anneal each core or stack at the peak temperature for two hours.

It is therefore highly desirable that a reel of amorphous metal strip be annealed by being unwound and fed through a solenoid using the proper combination of time and temperature. The annealed material would then be recoiled or stacked for utilization similar to a purchase low-loss coil.

This invention is directed to a process for efficiently annealing an amorphous metal strip to be used in transformer cores. The process may be summarized as comprising unwinding the strip from reel, cutting it, flattening it with rollers or a press, annealing these strips at favorable annealing conditions (less than two hours at peak temperature) through a solenoid in a conveyor furnace, and stacking the punchings into core.

More specifically, according to the present invention (and looking at FIG. 1), the amorphous metal strip can be unwound from a coil 10 and fed along a conveyor section 12 to a cutting punch 14 where the strips will be cut into the dimensions need for core punchings. A laser, abrasive wheel or a shear can be used for the cutter 14.

The cut punchings 16 are then fed along a further conveyor section 18 through flattening pincher rollers 20 or a press. These rollers are located inside the entry section of the furnace 22 so that the punchings are flattened during the stage of heating from room temperature to approximately 300° C. Molten metals adhering to the laser-cut edges or burrs from the mechanical shear can be mechanically removed or brushed off.

The strips are then passed through a section of maximum heating where a magnetic solenoid 24 is also located. The strips 18 are thermally and magnetically annealed in the soaking area in a non-oxidizing (e.g., nitrogen) environment). The time required for annealing will depend upon strip gauge and width, and also the need of the end results. More specific data will be provided below.

The annealed strips are then cooled to room temperature at the exit are 26 and the processed punchings will be ready for core stacking without further strip winding and unwinding.

The magnetic properties of amorphous metal strips can be improved with short time annealing through a conveyor furnace. Refer to FIGS. 2 and 3.

At low temperature (338° C. or 370° C.) annealing, losses improved slowly and continuously as the number of heating cycles increased. The exciting power, however, was still high (3.43 VA/lb and 2.55 VA/lb at 14 kG) at the end of fifth cycle. Refer to Groups 2 and 3 in Table I. At elevated temperature (445° C.) annealing, losses decreased rapidly, but deteriorated after the first cycle of annealing. Refer to Group 6 in Table I.

Annealing at various temperatures from high to low helped to improve the exciting power (1.14 VA/lb at 14 kG at the end of the combination heating in Group 7, Table I). There was no significant difference in the core loss for strips either annealed with one temperature or multiple temperatures. Compare Group 7 with Groups 2 through 6 in Table I. Such annealing cycle shown here lasted about one minute. Longer duration cycles may be possible.

Experimentally, seven groups of samples, each consists of 50 strips of 660 mm long, 50 mm wide, 38 μm nominal thickness Allied Corporation's 2605S-2 material, were prepaed. Each group of samples was annealed in a conveyor furnace by placing two strips at a time, one on top of the other, on a 50 mm wide continuous copper strip and moving it through a solenoid with a 10 Oe field at a rate of 152 mm/min. The annealing temperature of the furnace was 400° C., 420° C., 450° C., 475° C., and 500° C., respectively, for a total of five groups of the samples. The actual strip temperature, however, was measured at 338° C.±1° C., 370° C.±5° C., 383° C.±5° C., 412° C.±10° C., and 445° C.±10° C. for each respective group. All strips were annealed at the peak temperature for one minute during each annealing cycle. The annealed strips were loaded in a large size Epstein frame (ten strips per leg) for the loss measurements. The strips were annealed and tested for several cycles.

One group of samples was batch annealed in a Blue M box furnace using the conventional method of two hours at 400° C. with a field of 10 Oe for comparison.

Another group of samples was annealed in the conveyor furnace at 475° C. (strip temperature 412° C.) for two cycles, 450° C. (strip temperature 383° C.) for one cycle, and then 420° C. (strip temperature 370° C.) for four cycles (each cycle being of about one minute) to optimize the process.

FIG. 1 schematically depicts the basic concept of continuous strip annealing from uncoiling through strip cutting, flattening, magnetic annealing, core stacking, and then testing. In this experiment, strips were sheared one at a time with a conventional shear, and then annealed through a conveyor furnace.

FIGS. 2 and 3 illustrate core less and the exciting power, respectively, at 14 kG versus the number of heating cycles for five groups of amorphous metal strip samples annealed in a conveyor furnace one minute per each cycle at peak temperature. The sample temperatures were actually measured in the ranges of 338° C.±1° C., 370° C.±5° C., 383° C.±5° C.,±412° C.±10° C., and 445° C.±10° C. for each respective group.

Both core loss and exciting power dropped rapidly during the first heating cycle. The improvement was more effective for strips being annealed at elevated temperatures than at lower temperatures. Losses further improved for the subsequent cycles at lower temperatures, but deteriorated at elevated temperatures.

Table I summarizes the losses of amorphous metal strips in the as-cast condition tested in the Epstein frame (0.187 W/lb and 14.5 VA/lb at 14 kG) and then tested after each annealing condition.

Strips Group 1 were annealed two hours continuously at 400° C. in a Blue M furnace for a complete stress relief and magnetic anneal. Losses were 0.105 W/lb and 0.459 VA/lb at 14 kG.

Strips in Groups 2 through 6 were annealed in a conveyor furnace one minute per cycle for three to five cycles at 338° C., 370° C., 338° C., 412° C. and 445° C., respectively. The core loss at 14 kG improved as the number of heating cycles increased for strips being annealed at 338° C. (0.123 W/lb to 0.105 W/lb), and 370° C. (0.109 W/lb to 0.105 W/lb). The core loss at 14 kG, however, increased as the number of heating cycles increased after the first cycle for strip being annealed at 445° C. (0.113 W/lb to 0.125 W/lb) and for strips after completion of the fourth cycle of annealing at 412° C. (0.115 W/lb to 0.117 W/lb), and 383° C. (0.108 W/lb to 0.114 W/lb).

The exciting power at 14 kG improved in all cases, except after the completion of the fourth cycle of annealing at 412° C. and the third cycle of annealing at 445° C., the exciting power became poorer.

Strips in Group 7 were annealed two cycles at 412° C., one cycle at 383° C., and five cycles at 370° C.

Losses dropped substantially from the as-cast condition to the end of annealing cycles (from 0.187 W/lb and 14.5 VA/lb to 0.125 W/lb and 1.21 VA/lb). The core loss, however, was still 7.6% and the exciting power was approximately 2.5 times higher than the respective loss of strips which were batch annealed in the Blue M furnace.

However, the experiment has demonstrated that the magnetic properties of amorphous metal strips can be improved with a short time annealing at temperature ranges outside the established annealing conditions, which are 360° C.±10° C. for 2605 S-C Metglas material, and 400° C.±20° C. for 2605-S2 Metglas material through a conveyor furnace.

TABLE I

Loss Improvement of Amorphous Metal Strips Annealed in a Conveyor Furnace

| | | Induction (kG) | | | | | | | |
|---|---|---|---|---|---|---|---|---|---|
| | | 12 | | 13 | | 14 | | 15 | |
| | | W/lb | VA/lb | W/lb | VA/lb | W/lb | VA/lb | W/lb | VA/lb |
| | As-Cast Conditions | .145 | 7.75 | .167 | 10.8 | .187 | 14.5 | .207 | 19.7 |
| Group 1 | Annealed in a Blue M furnace two hours at 400° C.* | .076 | .181 | .089 | .270 | .105 | .459 | .126 | 1.26 |
| Group 2 | Annealed in a conveyor furnace one minute for each cycle at 338° C.* | | | | | | | | |
| | 1st | .105 | 3.85 | .114 | 5.45 | .123 | 7.68 | .130 | 10.8 |
| | 2nd | .103 | 3.38 | .114 | 4.72 | .130 | 6.65 | .139 | 9.81 |
| | 3rd | .091 | 2.42 | .101 | 3.51 | .112 | 5.08 | .122 | 7.75 |
| | 4th | .095 | 2.15 | .103 | 3.16 | .111 | 4.66 | .120 | 7.33 |
| | 5th | .088 | .088 | 1.44 | 2.25 | .105 | 3.43 | .114 | 5.56 |
| Group 3 | Annealed in a conveyor furnace one minute for each cycle at 370° C.* | | | | | | | | |
| | 1st | .090 | 1.52 | .101 | 2.34 | .109 | 3.76 | .122 | 6.12 |
| | 2nd | .088 | 1.24 | .096 | 2.06 | .111 | 3.48 | .122 | 5.96 |
| | 3rd | .084 | 1.04 | .094 | 1.71 | .101 | 2.92 | .115 | 5.24 |
| | 4th | .086 | 1.00 | .095 | 1.67 | .105 | 2.93 | .118 | 5.32 |
| | 5th | .082 | .878 | .097 | 1.44 | .105 | 2.55 | .115 | 4.81 |
| Group 4 | Annealed in a conveyor furnace one minute for each cycle at 383° C.* | | | | | | | | |
| | 1st | .082 | .603 | .094 | 1.05 | .107 | 2.07 | .124 | 4.44 |
| | 2nd | .081 | .503 | .094 | .895 | .107 | 1.83 | .126 | 4.20 |
| | 3rd | .080 | .489 | .091 | .860 | .108 | 1.73 | .124 | 3.98 |
| | 4th | .082 | .488 | .097 | .857 | .114 | 1.74 | .133 | 4.01 |
| Group 5 | Annealed in a conveyor furnace one minute for each cycle at 412° C.* | | | | | | | | |
| | 1st | .087 | .564 | .102 | .963 | .115 | 1.84 | .130 | 3.93 |
| | 2nd | .083 | .448 | .099 | .756 | .114 | 1.42 | .131 | 3.22 |
| | 3rd | .084 | .426 | .102 | .714 | .115 | 1.35 | .134 | 3.15 |
| | 4th | .086 | .451 | .102 | .753 | .117 | 1.42 | .136 | 3.25 |
| Group 6 | Annealed in a conveyor furnace one minute for each cycle at 445° C.* | | | | | | | | |
| | 1st | .083 | .373 | .097 | .611 | .113 | 1.11 | .128 | 2.43 |
| | 2nd | .088 | .377 | .103 | .609 | .119 | 1.09 | .138 | 2.37 |
| | 3rd | .093 | .441 | .109 | .700 | .125 | 1.21 | .150 | 2.54 |
| Group 7 | Annealed in a conveyor furnace one minute for each cycle at: | | | | | | | | |
| | 412° C. | | | | | | | | |
| | 1st | .089 | .481 | .107 | .799 | .123 | 1.43 | .140 | 2.91 |
| | 2nd | .094 | .476 | .105 | .774 | .119 | 1.37 | .140 | 2.82 |
| | 383° C. | | | | | | | | |

TABLE I-continued

| | Loss Improvement of Amorphous Metal Strips Annealed in a Conveyor Furnace | | | | | | | |
|---|---|---|---|---|---|---|---|---|
| | Induction (kG) | | | | | | | |
| | 12 | | 13 | | 14 | | 15 | |
| | W/lb | VA/lb | W/lb | VA/lb | W/lb | VA/lb | W/lb | VA/lb |
| 1st | .092 | .480 | .105 | .786 | .121 | 1.40 | .140 | 2.84 |
| 370° C. | | | | | | | | |
| 1st | .088 | .402 | .101 | .686 | .121 | 1.27 | .142 | 2.67 |
| 2nd | .086 | .381 | .099 | .656 | .113 | 1.22 | .131 | 2.62 |
| 3rd | .085 | .369 | .097 | .634 | .113 | 1.18 | .131 | 2.51 |
| 4th | .086 | .389 | .100 | .663 | .117 | 1.22 | .135 | 2.65 |
| 5th | .085 | .360 | .094 | .502 | .113 | 1.14 | .129 | 2.46 |

*Sample Temperature

What is claimed is:

1. A method of magnetic field annealing of amorphous metal strip for use in a transformer core, comprising the steps of cutting amorphous metal strip into a plurality of separate blanks as needed for a transformer core, feeding each of said metal blanks through a heat source to heat said blanks, and flattening each of said blanks, thermally and magnetically annealing each of said blanks at a temperature greater than about 360° C., and cooling said blanks whereby they are prepared for stacking into a transformer core.

2. A method as claimed in claim 1 including the further step of flattening each of said blanks prior to heating each of said blanks to said temperature greater than 360° C.

3. A method as claimed in claim 2 wherein the step of flattening each of said blanks is carried out during heating of said blanks from room temperature to a temperture of 300° C.

4. A method as claimed in claim 3 including the step of annealing each of said blanks in a nitrogen atmosphere.

5. A method as claimed in claim 4 wherein said annealing step is carried out in a series of one-minute heating cycles.

6. A method as in claim 2 wherein said flattening step is carried out with pinch rollers.

7. A method as in claim 2 wherein said flattening step is carried out with a press.

8. A method as in claim 4 wherein said annealing step is carried out over several minutes in a single heating cycle.

* * * * *